US006334421B1

(12) United States Patent
Singer et al.

(10) Patent No.: US 6,334,421 B1
(45) Date of Patent: Jan. 1, 2002

(54) MOTOR SAW

(75) Inventors: Andreas Singer, Fraureuth; Jochen Schoenhaar, Regensburg, both of (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 09/674,676

(22) PCT Filed: Jun. 25, 1999

(86) PCT No.: PCT/EP99/04434

§ 371 Date: Nov. 3, 2000

§ 102(e) Date: Nov. 3, 2000

(87) PCT Pub. No.: WO00/00330

PCT Pub. Date: Jan. 6, 2000

(30) Foreign Application Priority Data

Jun. 29, 1998 (DE) ..... 198 28 727

(51) Int. Cl.[7] ..... F02B 63/02

(52) U.S. Cl. ..... 123/195 A; 123/73 A; 123/184.21

(58) Field of Search ..... 123/198 E, 73 A, 123/73 B, 73 C, 195 A, 73 AD, 184.21, 184.23

(56) References Cited

U.S. PATENT DOCUMENTS 3,542,095 A * 11/1970 Frederickson ..... 132/32
3,782,343 A * 1/1974 Notaras et al. ..... 123/184.21
4,469,316 A 9/1984 van den Boom et al.
4,788,951 A * 12/1988 Nagashima ..... 123/198 E
4,835,866 A * 6/1989 Nagashima ..... 123/73 AD
5,029,393 A 7/1991 Nagashima et al.
5,212,886 A 5/1993 Tasaki
5,243,939 A 9/1993 Viktorsson et al.

FOREIGN PATENT DOCUMENTS

DE 7304706 11/1973
DE 39 27 218 A1 2/1991
DE 197 53 689 A1 6/1998

* cited by examiner

*Primary Examiner*—Marguerite McMahon
(74) *Attorney, Agent, or Firm*—McCormick, Paulding & Huber LLP

(57) ABSTRACT

In order to create (100) with a motor (101) which is fixed to a casing (102) and which shows an intake port (11) which is connected with a carbureter (16) for decoupling oscillations over an elastic suction hose (15), the carbureter (16) itself taking its bearing on the casing (102) by means of fixing means (21, 15), which avoids the disadvantages of the solution existing up to now and which makes possible especially a vibration-free bearing of the carbureter which is simple, easy servicing and which can be realized at low cost, it is proposed that the bearing of the carbureter (16) on the casing (102) is carried out substantially resiliently for damping or reducing the oscillations and the bearing of the resiliently hinged carbureter is carried out by means of an one-point suspension.

14 Claims, 3 Drawing Sheets

MOTOR SAW

FIELD OF THE INVENTION

This invention relates to a motor saw with a motor which is fixed to a casing and which shows an intake port which is connected for decoupling oscillations with a carbureter over a resilient suction hose, the carbureter itself taking its bearing on the casing by means of fixing means.

BACKGROUND OF THE INVENTION

Such a motor saw is known for example from the document DE-A1-42 34 483.

The carbureter of a motor saw driven by an internal combustion engine (generally a high-speed two-cycle engine) has a considerable influence onto the operating behaviour of the device. Oscillations which come from the moving piston of the motor and act onto the carbureter can result in an irregular fuel supply which endangers a trouble-free motor operation. For this reason, it is already known by the prior art for motors which are provided with a carbureter to connect the carbureter with the motor by means of a resilient admission pipe and to additionally create a resilient suspension of the carbureter in the casing. Such resilient suspensions can be made available by a few types of resilient elements, normally made of rubber. Due to such elements, it is possible to obtain an efficient vibration insulation of the carbureter. However, it is a disadvantage of such a suspension that sufficiently resilient elements for the vibration insulation make too important movements of the carbureter possible. A resilient admission pipe is, for example, known from DE-GM 1 762 310 or by SE-PS 8 6022 481-7. Because of the permanently increasing requirements with respect to the reduction of exhaust emissions, a safe motor operation is necessary. An exact adjustment of the carbureter is the condition of low exhaust emissions. Therefore, an oscillation reduced fixation of the carbureter in the suction space would be very advantageous. Furthermore, the fixation of the carbureter should be simple and easy servicing at low cost. From the above mentioned document DE-A1 42 34 483, it is now known to decouple the oscillations from the intake port of the motor by a gas admission pipe made of an elastomer. The carbureter is hinged to the operating area of the saw over a hinge joint in order to be able to move relatively freely in direction of the gas admission pipe.

However, the known hinge joint has different disadvantages. On the one hand, such a connection is comparatively expensive and has a comparatively complicated structure because parts with hinge bores must be produced and the hinge joints must be equipped with corresponding hinge bolts. On the other hand, the mounting and dismounting for servicing is complicated because the hinge bolts must be mounted and locked in the hinge joints with much expenditure and/or unlocked and dismounted. Finally, the hinge joint allows only a limited movability of the carbureter, namely in direction transversely to the hinge joint. On the contrary, a movability in direction of the hinge joint can only be realized with much expenditure if the hinge pins are configured resiliently.

Therefore, it has also already been proposed with DE 197 53 689 A1 a suspension for a carbureter which comprises at least one resilient element which is fixed to the casing and which is connected with the carbureter in order to allow a certain extent of movement of the carbureter relative to the housing, a supporting device limiting the extent of the movement. However, this is bound to disadvantages since, due to the limiting and the thus direct connected support of the carbureter, vibrations are still transmitted in an extent which is not to be tolerated.

SUMMARY OF THE INVENTION

Therefore, the aim of the invention is to create a motor saw which avoids the disadvantages of the solution until now and which especially makes possible a vibration free bearing of the carbureter which is simple, easy servicing and which can be realized at low cost.

This aim is achieved for a motor saw of the above mentioned type by the characteristics indicated in claim 1. Due to the renunciation according to the invention to a hinge joint of the carbureter on the casing by means of hinge bolts and the like and to any supporting and delimiting device, the bearing is much simplified. Simultaneously, due to the resiliently articulated one-point suspension, a bearing is obtained which fixes the carbureter in space but which simultaneously decouples it from the oscillations of the motor and of the casing due to the resilient movability in different directions in space. Due to the renunciation to supporting walls and stoppers, an efficient damping device is created. Due to the preferably progressive characteristic curve of the spring constant of the resilient element, it is obtained that higher frequency oscillations as well as oscillations with lower frequency are efficiently damped.

Due to the central arrangement of the damping part and to the chosen one-point fixing, a damping in all planes, i.e. in all directions is achieved.

A first preferred embodiment of the motor saw according to the invention is characterized in that a seat made of an elastic material, especially a resilient bushing made of rubber, is fixed to the casing and that the carbureter is detachably snapped-in with a snap-in part into the seat or the resilient sleeve. The carbureter can thus be very easily mounted by snapping-in into the seat and dismounted by snapping-out of the seat.

A particularly simple snap-in procedure and a very movable bearing result when, according to a preferred further development of the embodiment, the snap-in part is configured as a ball head. Due to the renounciation to snap-in edges, the snap-in part can be snapped in and out with a comparatively low resistance. The ball head acts additonally as a ball joint.

A trunnion which is stuck through the sleeve (not represented) can also be configured instead of the ball head. Thus, the sleeve can be configured with still bigger dimensions (for example air chamber) in order to achieve a special damping characteristic and to simultaneously guarantee a "fixed" adjustment (fixing).

A further embodiment of the resilient sleeve allows a configuration of the damping element which is much more resilient. Due to the very resilient configuration, the mounting procedure of the damping element not together with the suction flange is possible. Therefore, the damping element is separated from the suction flange and preliminarly placed in the mounting sequence. The suction flange is snapped-in later. For the configuration of the damping element, due to the ellispoidal form a very "smooth" characteristic curve in direction of the carbureter bottom can be obtained. On the contrary, in the crankshaft axle direction, the spring characteristic will turn out harder. Thus, the whole suction system can be positioned very smoothly but still axially safe.

Further embodiments result from the depending claims.

BRIEF DESCRIPTION OF THE DRAWINGS

Embodiments of the invention will be explained in more detail below with reference to the attached drawings.

DETAILED DESCRIPTION OF THE PREFERRED EMBODIMENT

Figure 1:
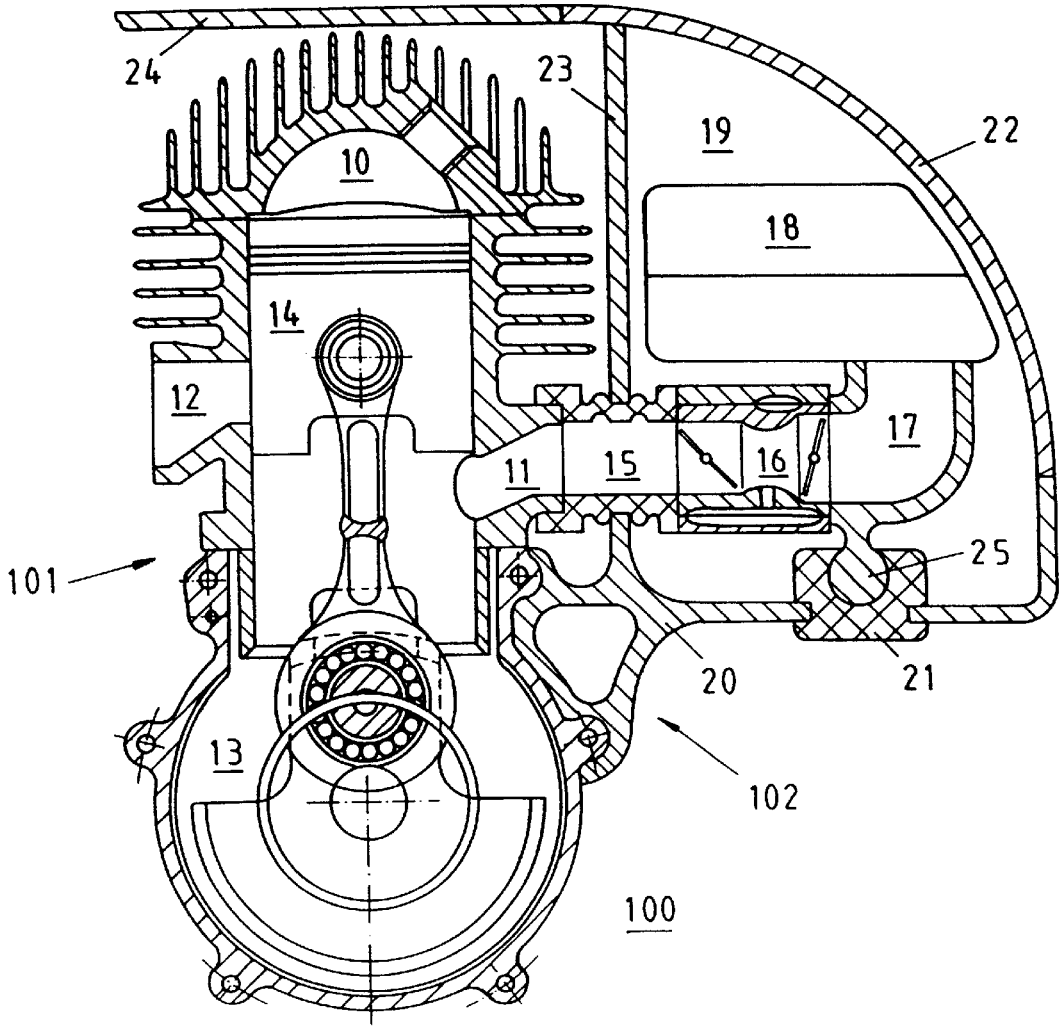
FIG. 1 shows in a sectional view a part of a preferred embodiment of a motor saw according to the invention with the motor and with the carbureter connected therewith which is resiliently positioned in a resilient seat in the casing bottom over a ball head moulded on the intake manifold.

The motor 101 of a motor saw 100 is represented in FIG. 1 in a cut partial view. The motor 101, which comprises a cylinder 10 with an intake port 11 and a discharge channel 12 as well as a piston 14, is screwed with its crankcase 13 on the bottom 20 of a casing 102. The casing 102 encompasses the motor 101 at least partially and is connected on top by a cap 24. Inside the casing 102, a suction space 19 which is besides the motor 101 is separated by a vertical partition 23, whereby this suction space is closed on top by a (removable) cover 22 and in which a carbureter 16, especially in form of a diaphragm carbureter, is placed. The carbureter 16 is connected on the outlet side by a resilient suction hose 15 to the intake port 11 of the motor 101. The suction hose 15 penetrates through an opening in the partition 23 and is positioned there in snap-in position. On the inlet side, the carbureter 16 changes into an intake manifold 17 which is bent-off upwards and discharges into an air filter 18.

A ball head 25 is moulded on the intake port 17 on the lower side, ball head which snaps in into a resilient sleeve 21 of rubber. The resilient sleeve 21 possesses itself noses or trunnions with which it can be stuck-in in a snap-in position into one (or several) opening(s) which are in the bottom 20 or with which it can be stuck through. A differently formed nose or a trunnion with undercut can be naturally used instead of the ball head 25, whereby they can be stuck-in or stuck through into a correspondingly formed opening in the resilient sleeve or in a comparable resilient seat. However, the ball head 25 has the particular advantage that it can be particularly easily stuck-in and that it simultaneously acts as a ball joint.

Because of the resilient embodiment of the sleeve 21 or of the seat, the transmission of oscillations to the carbureter 16 can be considerably reduced. Simultaneously, the carbureter 16 which is connected (for the further avoiding of heat transmission and oscillations) over the resilient suction hose 15 with the cylinder 10 is fixed in all necessary directions.

The mounting and dismounting are strongly simplified because of the simple snapping-in of the ball head 25 into the opening provided for this purpose in the resilient sleeve 21. For the mounting, first the resilient sleeve (seat) 21 is mounted in the bottom 20 of the casing 102, then the intake manifold 17 with the carbureter suspended on it. The dismounting is carried out in the reverse order. No tool is required for this.

Figure 2:
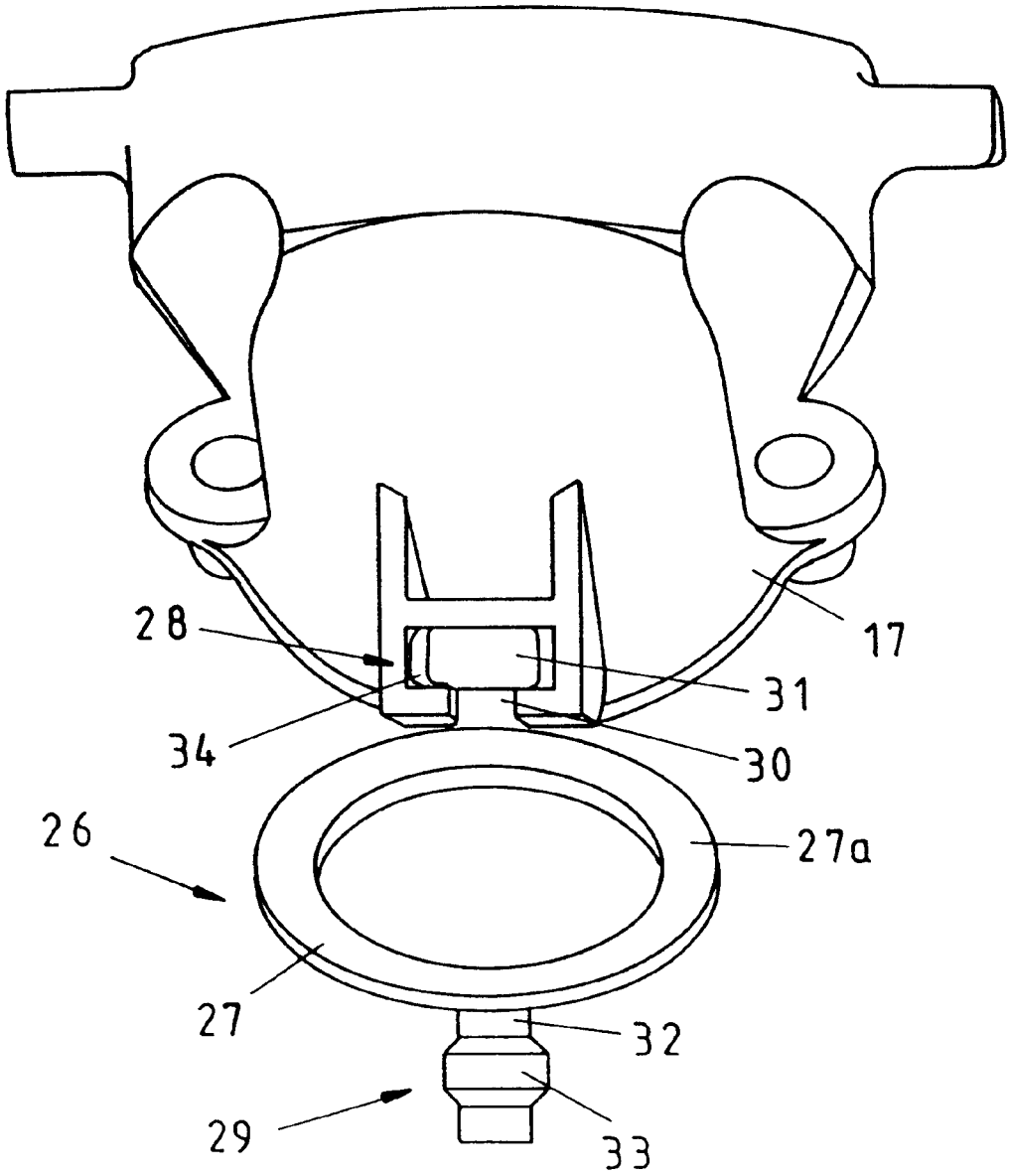
FIG. 2 shows a resilient sleeve in a schematical view.

In FIG. 2, a further embodiment of a resilient sleeve 26 is represented which consists of a resilient ring-shaped damping body 27 with fixing means 28, 29 moulded thereon for fixing on the casing bottom 20 and on the intake manifold 17. The damping body 27 is optimally adjustable with respect to the desired elasticity and damping behaviour through the selection of the diameter of the ring 27*a* and of the cross-section of the body. The fixing parts 28, 29 can have different configurations. The fixing part 28 shows a rod-shaped retaining arm 30 with an end-sided snap-in knob 31, while the fixing part 29 shows a rod-shaped retaining arm 32 with a snap-in connection 33. The snap-in knob 31 is pushed-in into a correspondingly formed snap-in seat 34 on the intake manifold 17, while the retaining arm 32 is snapped-in into a corresponding seat (not represented) in the casing bottom 20.

Figure 3:
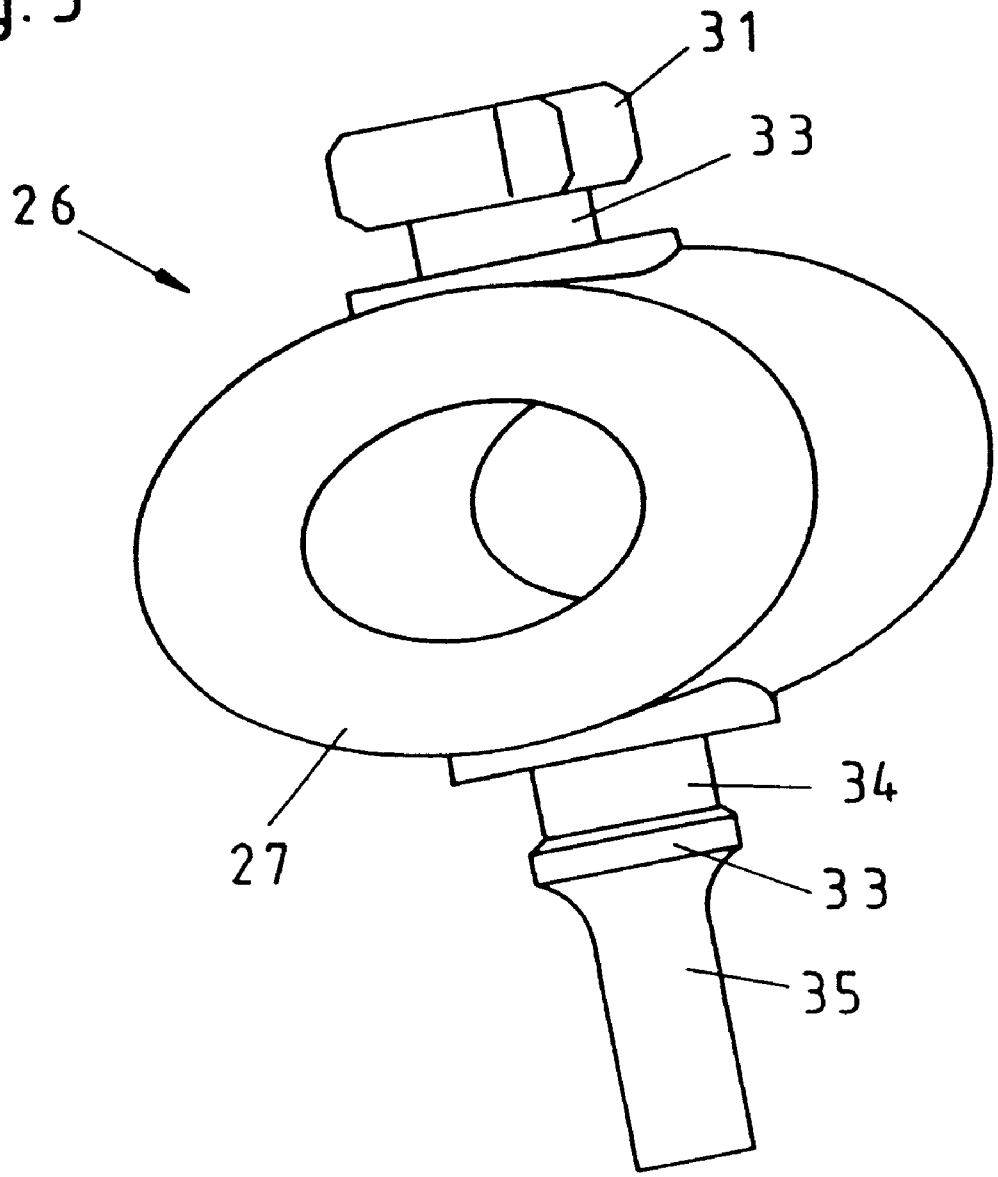
FIG. 3 shows a schematical view of a further embodiment of a resilient sleeve in the mounting situation snapped-in the intake manifold.

A further embodiment of a sleeve 26 is represented in FIG. 3, the retaining arm 34 of which is stuck-in with the projecting end part 35 into the casing bottom 20.

On the whole, it results from the invention a motor saw with an internal combustion engine for which the carbureter is practically decoupled of harmful oscillations in a simple, low-cost ways easy for mounting and servicing.

What is claimed is:

1. A motor saw (100) with a motor (101) which is fixed to a casing (102) and which shows an intake port (11) which is connected for decoupling oscillations with a carbureter (16) over a resilient suction hose (15), the carbureter itself taking its bearing on the casing (102) by means of fixing means (21,25), characterized in that the bearing of the carbureter (16) on the casing (102) is carried out substantially resiliently for damping or reducing the oscillations and the bearing of the resiliently hinged carbureter (16) is carried out by means of a one-point suspension, said one-point suspension comprising an elastic, removable attachment between a lower portion of an intake manifold (17) an the casing (102).

2. A motor saw according to claim 1, characterized in that a seat made of an elastic material, is fixed to the casing (102) and that the carbureter (16) is detachably snapped-in with a snap-in part (25) into the seat.

3. A motor saw according to claim 1, characterized in that the one-point suspension is substantially resilient for damping having a spring characteristic configured for damping both higher frequency oscillations and lower frequency oscillations.

4. A motor saw according to claim 2, characterized in that the snap-in part (25) is configured as a ball head.

5. A motor saw according to claim 2, characterized in that the casing (102) comprises a bottom (20) and that the seat is snapped-in into an opening in the bottom (20) provided for this.

6. A motor saw according to claim 5, characterized in that the casing (102) comprises a partition (23) placed substantially vertically to the bottom (20) between the motor (101) and the carbureter (16) and that the resilient suction hose (15) extends through an opening in the partition (23) and is positionable in a snap-in position in said opening.

7. A motor saw according to claim 2, characterized in that the carbureter (16) is removably attached to intake manifold (17), said intake manifold (17) comprising the snap-in part (25) moulded thereon.

8. A motor saw according to claim 1, characterized in that the means of an one-point suspension, further comprises a first fixing means (28) for the removable fixing to the carbureter (16) and a second fixing means (29) for the removable fixing to the casing (102) and a resilient connecting means (27) between the first fixing means (28) and the second fixing means (29).

9. A motor saw according to claim 8, characterized in that the resilient connecting means (27) is configured ring-shaped.

10. A motor saw according to claim 8, characterized in that the first fixing means (28) is configured T-shaped and can be pushed-in into a corresponding T-shaped receiving groove or recess on the carbureter (16).

11. A motor saw according to claim 8, characterized in that the first fixing means (28) comprises a snap-in head and a corresponding seat for receiving said snap-in head for removable attachment to said carbureter (16).

12. A motor saw according to claim 2, characterized in that the seat is a resilient bushing (21) made of rubber.

13. A motor saw according to claim 8, characterized in that the second fixing means (29) comprises a T-shaped and can be pushed-in into a corresponding T-shaped receiving groove or recess on the casing (102).

14. A motor saw according to claim 8, characterized in that the second fixing means (28) comprises a snap-in head and a corresponding seat for receiving said snap-in head for removable attachment to said casing (102).

* * * * *